United States Patent [19]

Burk et al.

[11] Patent Number: 4,893,939

[45] Date of Patent: Jan. 16, 1990

[54] MIXING APPARATUS AND MIXING METHOD

[75] Inventors: Klaus Burk; Ulrich Burk, both of Overath, Fed. Rep. of Germany

[73] Assignee: Kunststoff-Spritzgusswerk Ing. Klaus Burk KG, Fed. Rep. of Germany

[21] Appl. No.: 21,203

[22] Filed: Mar. 3, 1987

[30] Foreign Application Priority Data

Mar. 11, 1986 [DE] Fed. Rep. of Germany ..... 3608038

[51] Int. Cl.[4] ..... B01F 9/12

[52] U.S. Cl. ..... 366/224; 366/286; 366/309; 366/605

[58] Field of Search ..... 366/224, 605, 309–313, 366/279, 287, 288, 285, 286

[56] References Cited

U.S. PATENT DOCUMENTS

| | | | |
|---|---|---|---|
| 1,040,427 | 10/1912 | Savage | 366/309 |
| 1,415,735 | 5/1922 | Trust | 366/309 |
| 2,481,731 | 9/1949 | Dubin | 366/309 |
| 2,651,582 | 9/1953 | Courtney | 366/224 |
| 2,991,051 | 7/1961 | Jones | 366/279 |
| 3,747,899 | 7/1973 | Latinen | 366/310 |
| 4,151,792 | 5/1979 | Nearhood | 366/312 |
| 4,166,705 | 9/1979 | Fronske | 366/224 |
| 4,403,867 | 9/1983 | Duke | 366/224 |

FOREIGN PATENT DOCUMENTS

| | | |
|---|---|---|
| 968209 | 6/1956 | Fed. Rep. of Germany . |
| 1161860 | 1/1964 | Fed. Rep. of Germany . |
| 7213010 | 8/1972 | Fed. Rep. of Germany . |
| 2922263 | 12/1980 | Fed. Rep. of Germany . |
| 376585 | 12/1984 | Fed. Rep. of Germany . |

*Primary Examiner*—Robert W. Jenkins

*Attorney, Agent, or Firm*—John F. A. Earley; John F. A. Earley, III

[57] ABSTRACT

In a mixing process and a mixing means a relative motion of a mixing vessel with respect to a mixing tool is provided such that adhering mixing products are removed from the bottom and the walls of the mixing vessel.

10 Claims, 4 Drawing Sheets

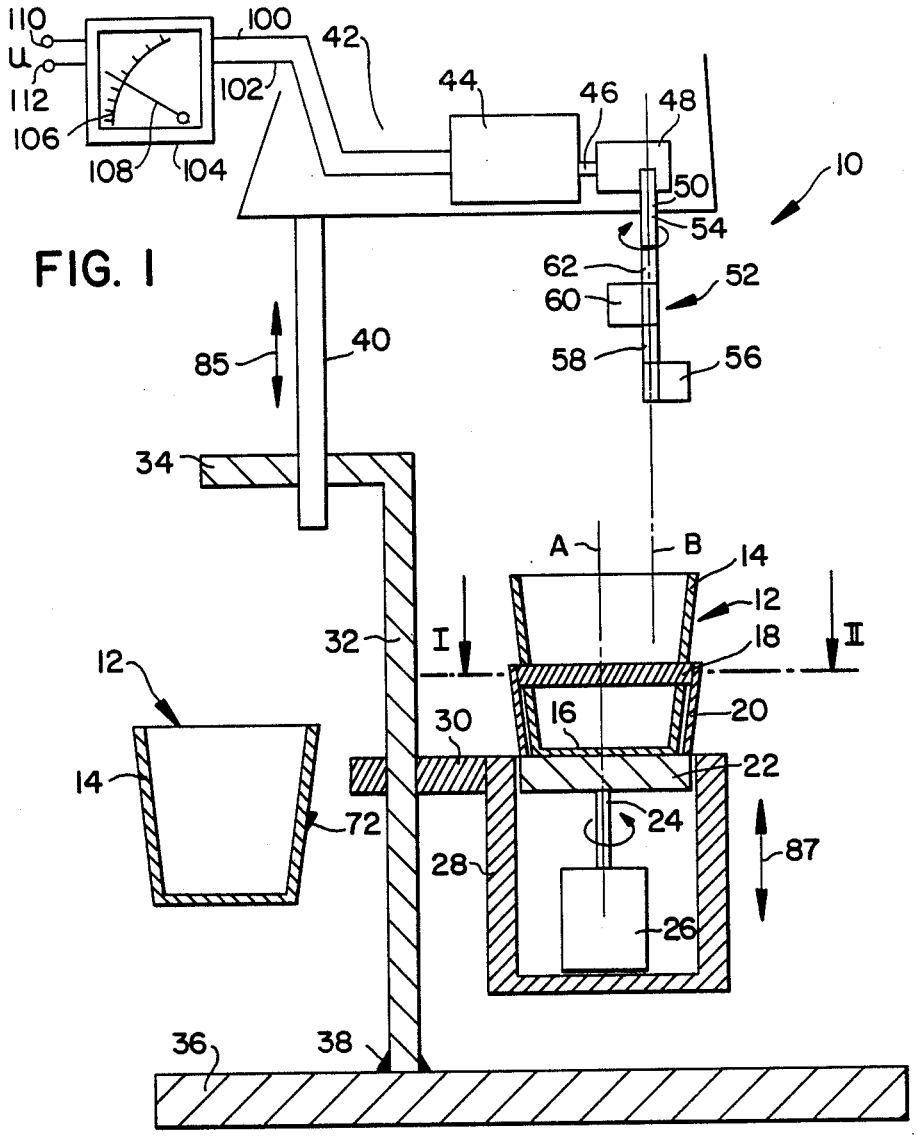
FIG. 1
FIG. 3
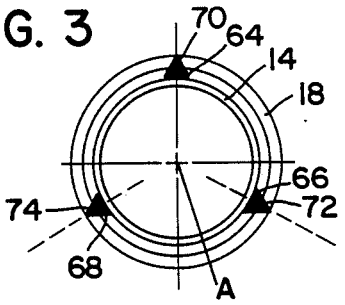
FIG. 2
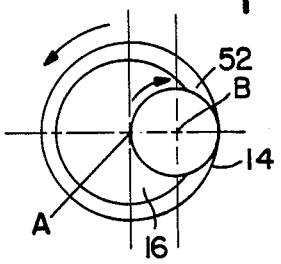

MIXING APPARATUS AND MIXING METHOD

DESCRIPTION

The present invention relates to a mixing apparatus and further relates to a mixing method. "Mixing" in this context is meant to include all operations where at least two components of a mixing product are to be mixed as homogenuously as possible. Furthermore, all operations are to be included where a single-component mixing "product" is to be homogenized in its consistency, for example by stirring up of substances which tend to settle. In principle, "mixing" with respect to the present invention includes all mechanically induced movements of flowable substances.

In particular the present invention relates to mixing of paints. Paints for coating surfaces, for example lacquers, are mixed for producing certain shades of color from paints of different shades of color. Further mixing operations with paints and lacquers happen where color pigments are introduced into an at least partially volatile carrier substance. In particular it is necessary for producing new paints and lacquers to mix a plurality of samples under standardized conditions for determining properties with respect to adhesive power, drying, obtainable variety of shades of colors, and so on in order to compare the samples with each other and with other samples.

Usually in such color mixing experiments the components to be mixed are put in standardized cups and are manually stirred with a spatula-like tool until a sufficient mixing of the components has taken place. This method is very time-consuming and therefore costly. Also, standardized conditions for the mixing process are hardly attainable because, apart from the stirring time which might relatively easily be held constant, the way of stirring has a substantial influence on the result of the mixing process. Therefore usually the stirring is continued until a mixing quality has been achieved which substantially depends on the individual judgement of an observer.

Attempts to carry out the mixing of such paint samples with, for example, magnetic stirrers, where a piece of magnetically influenceable material is brought into the mixing products and produces a stirring motion under the influence of an outer variable magnetic field, have led to standardized results. The mixing quality, however, was not satisfactory in many cases. A similar unsatisfactory result was obtained by using stirring apparatus similar to well-known household blenders.

It is, therefore, an object of the present invention to advance the prior art mixing apparatus and mixing process and to provide a mixing apparatus and a mixing process where a high mixing quality can be attained which before could only be achieved in manual operation, and to produce this quality under standardized conditions, if possible.

The present invention is based on the finding that in previous attempts to mechanize the mixing process the influence of the constituents of the mixing products which stick to the wall or the bottom of the mixing vessel has been neglected, and that in this manner only poorer results could be obtained than when stirring manually with spatula-shaped tools. Even with a low sticking power of goods to be mixed at least certain parts of the mixing products tend to stick to the inner walls (including the bottom) of a mixing vessel, thus evading the mechanical mixing process, such that the mixing is incomplete. With manual operation using a spatula, however, mixing products are stripped from the walls and the bottom of the mixing vessel and are included into the mixing process.

Concerning the mixing apparatus the objects are solved by providing a mixing means comprising at least one mixing tool and at least one mixing vessel for mixing products, where said mixing tool is disposed, with respect to said mixing vessel, for providing a relative motion of said mixing tool with respect to said mixing vessel, such that said mixing tool is, at least partially, in contact with the mixing chamber of said mixing vessel during the mixing process. "Mixing chamber" in this context means the regions of the inner walls and the bottom of a mixing vessel. Here not a contact with all inner surfaces of the mixing vessel is necessary, only as far as the vessel is filled with mixing products or, as far as these mixing products adheringly coates the inner chamber surfaces of the mixing vessel, respectively.

By grazingly contacting the inner surfaces of the mixing chamber during the mixing process with the mixing tool mixing products sticking to these surfaces are continuously removed from these surfaces and introduced into the mixing process such that a substantially complete mixing is achieved in a relatively short time. Therefore, according to the present invention mixtures can be performed in substantially less time and with substantially reduced efforts, compared to manual operation which was previously necessary. Of course, the mechanization of the entire mixing process makes a standardization of the mixing conditions particularly easy, because with a given mixing apparatus according to the present invention only the mixing time and the velocity of relative motion of the mixing tool with respect to the mixing vessel have to be adjusted.

The apparatus according to the present invention is also extremely versatile because it is suited to be used with very different mixing products. It may also be made in a plurality of embodiments, because it is only necessary that the mixing tool makes a relative motion with respect to the inner surfaces of the mixing vessel in such a manner that mixing products sticking thereto are stripped off. A very simple embodiment of the present invention would consist of guiding a spatula in a circulatory motion grazing along the inner surfaces of a mixing cup, and certainly also a fixed spatula could be employed and the cup be rotated around its central axis. Also, in a longish container with straight walls a spatula or a plurality of spatulas, one for each wall section, could be guided linearly grazing along the respective wall sections. For more complicated shapes of containers and/or movements of mixing tool or vessel a plurality of drive means is known in the art, for example by eccentric gear control or the like.

In a preferred embodiment of the mixing means according to the present invention a rotationally symmetric mixing vessel is provided which is rotatable around an axis, and the mixing tool is disposed on another axis which runs in spaced parallel relationship to the first axis. For producing a relative movement in this case the mixing tool may be guided with its axis along a circular path. According to an especially advantageous embodiment of the present invention, however, it is suggested to provide a rotating means for rotating the mixing vessel. A rotation may be provided much easier and, therefore, with less costs than a guidance along a circular path.

According to a further advantageous embodiment of the invention it is suggested that the rotating means comprises a rotary plate, on which the mixing vessel may be put, and driving means for the rotary plate. The rotary plate may be adapted to the shape of the mixing vessel and may, for example, comprise a recess for receiving the mixing vessel. On the other hand, the rotary plate may be a plane machine table as well. The drive means for the rotary plate is preferably an electric motor, either a so-called slow-speed motor or an electric motor coupled to a reducing gear or a so-called geared motor where the motor is interlocked with the gearing, because for paint mixing the revolving speed need not be very high. The revolving speed may preferably be controlled by electric means, for example by means of a variation of the voltage or, with alternating current motors, by phase control, in an easy and reproducible manner and may thus easily be adapted to a certain application, under consideration of the viscosity of a paint sample and the desired mixing time, for example. Furthermore, electric motors are especially suited for automatic operation where, for example, switch-on and -off and a preselected revolving speed of the electric motor is controlled by program control means.

In another advantageous embodiment of the invention the rotating means comprises receiving means for the mixing vessel. This may be a recess which is suitably adapted to the shape of the mixing vessel as described above. In a preferred embodiment of the invention the receiving means and the mixing vessel are detachably engaged by locking means. In this manner it may be achieved that a vessel put onto the rotary plate follows the movement of the rotary plate because the mutual interlocking ensures that no slip occurs. In another advantageous embodiment of the invention recesses are provided in the receiving means and on the mixing vessel protrusions shaped correspondingly to the recesses are provided. Of course also recesses might be provided in the mixing vessel and protrusions on the receiving means, for example.

In still another advantageous embodiment of the invention the receiving means is provided with a ring. Such a ring having an inner diameter larger than the outer diameter of the mixing vessel at the respective position may be provided with additional means for securing the vessel in the receiving means, for example with a quick-action chuck means.

According to a particular advantageous embodiment of the invention the mixing tool is rotatable. The stripping action exerted by the rotary motion of the mixing vessel the inner wall and bottom of which grazingly contact the mixing tool is thus enlarged. Preferably the rotation of the mixing tool is in opposite direction to the rotation of the mixing vessel.

In another advantageous embodiment of the invention the mixing tool comprises a central shaft to which at least one stirring piece is secured. The shaft may be of an extremely simple shape, mainly adapted for receiving the mixing tool, whereas the stirring piece may be optimized with respect to stirring and mixing properties. It has been found, for example, to be particularly advantageous if, according to another embodiment of the invention, stirring wings protruding from the shaft are provided. Such stirring wings may be relatively elastic such that they easily adapt to the shape of the inner wall and the bottom of the mixing vessel and thus provide a good stripping action. An extremely well-suited combination of high strength of the stirring wings in the area where they are secured to the shaft and high flexibility in their outer region where the stirring wings are in contact with the walls and in partial contact with the bottom of the mixing vessel is provided, according to another advantageous embodiment of the invention, by a tapered cross section of the stirring wings starting from the shaft to the outside.

The mixing quality may be improved for certain applications and for certain substances, according to another embodiment of the invention, by forming the mixing tool such that a relative motion of the mixing products at least partially transverse to the relative motion of the mixing tool and the mixing vessel is provided. If, for example, the mixing vessel and the mixing tool rotate around two parallel axes in distant relationship, then in addition thereto a further movement in an axial direction may be superimposed. This improves in particular the mixing of conglomerates consisting of a relatively heavy component in a light component where otherwise the heavy component would tend to quickly settle again on the bottom of the mixing vessel. The relative motion of the mixing products in an axial direction may be provided by forming the mixing tool accordingly, too. In another advantageous embodiment of the invention the mixing tool is formed at least partially in spiral shape for this purpose. Also oblique stirring wing sections or similar measures may be provided which lead to a suction or drawing action when the mixing tool rotates.

In another advantageous embodiment of the invention the mixing vessel and/or the mixing tool is movable in the direction of the axis of the mixing vessel or in the direction of the axis of the mixing tool, respectively. This may advantageously be achieved with a short length of stroke for providing the above-mentioned relative movement in an axial direction, for example in an intermittent fashion. The main purpose of this measure, however, is to dip the mixing tool in the mixing vessel after the mixing vessel with the mixing products has been put on. For this purpose either the mixing vessel may be fixed and the mixing tool be axially movable, like, for example, a drilling tool in a drill press. It is, however, also feasible in principle to have a rigid mixing tool in this respect and a receiving means for the mixing vessel which is movable by a length of stroke; a combination of these measures is feasible, too.

In still another advantageous embodiment of the invention a post is provided extending at least partially parallel to the axis of the mixing vessel, and a bracket is attached to the post and is slidingly movable with respect thereto, the bracket having support means secured thereto for the mixing vessel. Such a construction can be manufactured economically and has a long life, even under high stress conditions because of numerous stroke movements of the bracket along the post.

In another advantageous embodiment of the invention the support means comprises a housing in which the rotating means for the mixing vessel is located. In this manner an electric drive motor and the rotary plate, for example, are encapsuled and guarded against influences from the outside and follow easily the movement of the bracket.

According to another advantageous embodiment of the invention another axis is provided which extends parallel to the axis of the mixing tool, the second axis being slidably carried in a bracket and being secured, at one end, to a housing which is arranged, in a distal section with respect to the second axis, for receiving the mixing tool. At the same time this housing may contain the drive means for the mixing tool which may comprise an electric motor similar to the one already described in connection with the drive of the mixing vessel. In this manner the housing with the mixing tool may be moved by a displacement of the second axis in the bracket.

In a particularly advantageous embodiment of the invention the housing is slewable around the second axis. In this manner a plurality of advantages may be achieved. Firstly, the horizontal sweep of the housing with the mixing tool with respect to the rotary plate for the mixing vessel facilitates maintenance and cleaning because of the improved accessability of the parts. Furthermore, and this is very important, an arrangement of several rotary plates for a respective mixing vessel may be provided in a star-shaped arrangement disposed around a post. Then, for a plurality of mixing vessels and associated drive means only a single mixing tool drive is necessary which may be swept successively over the various mixing stations. For this purpose and for an easy alignment of the positions locking means are preferably provided for locking into the locking positions which correspond to these positions, for example locking means on the housing, the second axis or the axis traversing this bracket.

In another advantageous embodiment of the invention the length of the mixing tool is adapted to the dimensions of the mixing vessel. This is necessary first of all because the mixing tool has to extend down to the bottom of the mixing vessel in order to provide a stripping action there. This minimum length is therefore determined by the height of the mixing vessel. In series test operations it may be desired to close the mixing vessels after mixing with a suitable lid for storage for a certain time. For this purpose the mixing tool and the mixing vessel have to be separated, for example by one of the above-mentioned stoke movements, where usually the mixing tool remains in a position above the mixing vessel. If now the vessel is removed paint remainders on the mixing tool may drip onto the hand of an operator or onto a lid which has been put on the vessel, and this is bothersome, at least. Subsequently, the mixing tool with mixing products adhering thereto is disposed, for example into a waste container, and during this process also paint drops may contaminate the environment. The contamination has to be removed which takes time and costs.

All this may be avoided if the adaptation of the length of the mixing tool is such that, according to another advantageous embodiment of the invention, the mixing tool may be received in its entire length in the inside of the mixing vessel. Then the mixing tool may simply remain in the mixing vessel and a separate disposal of the mixing tool is no longer necessary.

In this respect it is advantageous if the mixing tool is lockingly receivable in a receiving means, according to another advantageous embodiment of the invention. In this case not only the installation of the mixing tool is fast but also a simple ejection of the mixing tool from its receiving means may be provided by a simple ejecting means which overcomes the locking means, thereby simply ejecting the mixing tool into the vessel without having to touch the tool after it has been contaminated with mixing products. A suitable locking means may comprise a groove at the radial outer circumference of the shaft of the mixing tool which is engaged by a radially movable locking rod disposed at the receiving means. The locking rod may be disengaged from the groove by pneumatic or electromagnetic means and thus release the tool which subsequently is conveyed into the mixing vessel under the action of another pneumatic or electromagnetic ejecting means.

The latter measures are, of course, only efficient if the mixing tool is a throw-away part and is in particular not costly. In this connection it is advantageous if the mixing tool is consisting of a single piece, because the manufacturing costs are reduced in particular in that case if the mixing tool is made of synthetic resin, according to another advantageous embodiment of the invention. Mixing tools consisting of a single piece and made from synthetic resin by injection molding are so cost-effective that they may be regarded as throw-away articles yielding the above-indicated facilitations in mixing tool change. The mixing vessel may also be made as a throw-away part and may consist, in this case, of synthetic resin manufactured by injection molding. Synthetic resins particularly suited for use with paints and lacquers for the mixing tool and mixing vessel are polyethylene and polypropylene, in particular because of their resistance against solvents.

Such synthetic resin containers are usually delivered in stacks of 100 pieces or more. If the mixing vessel only have a simple slightly conical shape it may happen that the pieces in this stack packing stick together so firm that removing single vessels is at least bothersome. In this context another particular advantageous embodiment of the invention suggests to form the locking protrusions on the mixing vessel such that they aid in stacking. The locking protrusions thus serve several requirements, firstly, as described above, for lockingly engaging the mixing vessel with a suitable receiving means for a rigid coupling with the rotary motion and, secondly, for stacking the vessels.

With respect to the mixing process the objects are attained by a mixing process according to the present invention comprising the following steps:

Feeding mixing products into a mixing vessel, immersing at least a section of a mixing tool into the mixing products, producing a relative motion of the mixing tool with respect to the mixing vessel, during which the mixing tool grazingly contacts at least a substantial part of the inner chamber of the mixing vessel covered by the mixing products.

The advantages attainable with the process according to the invention have largely been described above in connection with the description of the function of the means according to the present invention. It is, however, emphasized that the process according to the invention may be realised in numerous embodiments. In any case it is important to provide a sufficient stripping action of the mixing tool which strips off mixing products from the inner surfaces of the mixing vessel including the bottom.

As described in connection with the various means advantageous embodiments of the process according to the invention suggest to rotate the mixing vessel and/or the mixing tool, respectively. For this purpose according to another advantageous embodiment of the process according to the invention the mixing vessel may be rotated around a first axis and the mixing tool may extend substantially along a second axis which runs in spaced parallel relationship to the first axis.

In another advantageous embodiment of the process according to the invention the mixing products are moved, at least partially, in a direction transverse to the direction of relative motion of mixing vessel and mixing tool. This may be achieved by a suitable form of the mixing tool, thus inducing the mixing products to move in an axial direction with respect to the axis of the mixing tool, for example by oblique stirring wings, spiral-shaped sections of the mixing tool, or the like. As described above such an axially relative motion may be provided by stroke movements of the mixing vessel, of the mixing tool, or both.

The invention is subsequently explained in more detail in connection with embodiments shown in the drawings displaying further advantages and features.

In the drawings:

FIG. 1 shows a first embodiment of a mixing means for a mixing vessel and a mixing tool;

FIG. 2 is a top view for explaining the rotating radius of mixing vessel and mixing tool;

FIG. 3 is a top view of a receiving means for a mixing vessel with locking means.

Figure 4:
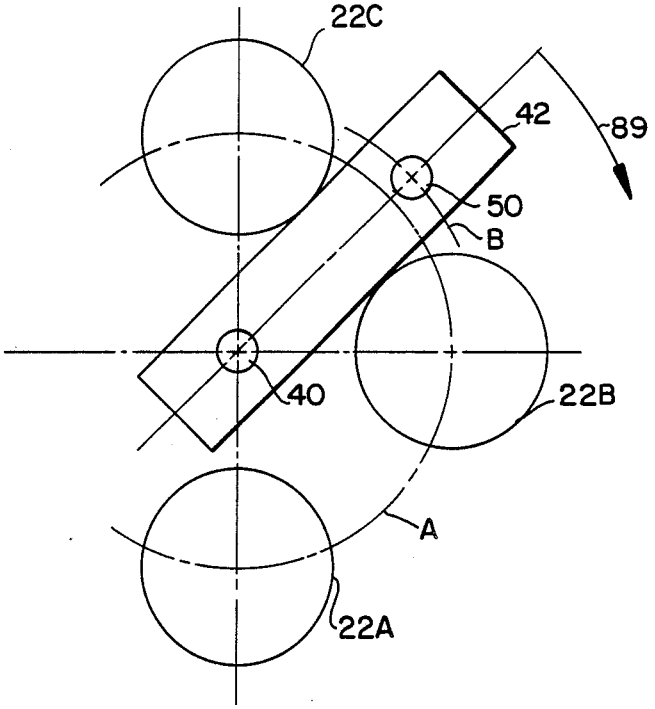
FIG. 4 is a second embodiment of a mixing means with three mixing vessel stations.

In FIG. 1 a mixing means is characterized as a whole by a reference number 10. A mixing cup 12 with a cup wall 14 and a cup bottom 16 is received in a support ring 18 secured, via a support 20, to a rotary plate 22. The support ring may be equipped with locking means adapted to cup 12 which locking means will be described subsequently in more detail in connection with FIG. 3. It is also feasible, however, to provide different measures for securing cup 12, for example by a suitable form of rotary plate 22. Also for aiding in supporting cup 12 on rotary plate 22 suction openings, for example, may be provided there in which, by means of suitable apparatus not shown here, for example a vacuum pump, a vacuum is produced which holds the bottom 16 on the rotary plate 22 because of the suction.

Rotary plate 22 is centrally connected to an axis 24 of an electric motor 26 which drives the rotary plate. Rotary plate 22 and motor 26 are surrounded at their sides and bottoms by a housing 28 which continues in a bracket 30. In the bracket a fitting bore is provided which is traversed by a post 32. Under the influence of a stroke means not shown in the figure the entire arrangement comprising rotary plate 22 and associated housing and drive parts is movable along post 32 and may be fixed there. Post 32 is secured in its footing section to a stable base plate 36 by means of a welding 38.

From the upper end of post 32 a further bracket 34 protrudes to the side and the bracket has a fitting bore for receiving an axis 40 at the distal end of which a housing 42 is provided. The axis 40 may be moved, with respect to bracket 34, in the direction of arrow 85. Also for this purpose a suitable stroke means may be provided which is not shown, for example similar to the height adjustment of a drill a press.

The housing 42 contains an electric motor 44 and an angular gear 48 connected by an axis 46. At the output side of angular gear 48 a receiving means 50 for a mixing tool 52 is located.

Mixing tool 52 is formed as a wing stirrer and comprises a central shaft 54 from which four stirring wings 56, 58, 60, and 62 protrude. In FIG. 1 wing 58 would protrude from the paper plane and wing 62 into the paper plane.

In receiving means 50 a holding and ejecting means for mixing tool 52 may be provided as described before. Shaft 54 is shaped accordingly, for example provided with a locking groove at its outer circumference.

The antirotation of drive axis 24 for the rotary plate 22 and of shaft 54, respectively, is indicated by associated arrows in FIG. 1.

The directions of rotation are further explained in FIG. 2 showing a top view of cup 12 with the upper section of wall 14 and bottom 16. The center of the cup is traversed by axis A which is also shown in FIG. 1. Parallel to axis A extends axis B of mixing tool 52. FIG. 2 explains that even with a fixed wing stirrer 52 a stripping action occurs at the inner walls and the bottom, c.f. FIG. 1, of cup 12 because of the rotary motion of cup 12. The stripping effect is, however, considerably improved if wing stirrer 52 rotates, too, as indicated by respective arrows in FIGS. 1 and 2.

FIG. 3 shows a support ring 18 according to FIG. 1 having three locking recesses 70, 72, and 74 which open towards the inside of the ring. These recesses 70, 72, and 74 engage with correspondingly shaped locking protrusions 64, 66, and 68 provided at the circumference of cup wall 14. One of these locking protrusions (72) is shown in the sectional view of cup 12 in the left-hand side of FIG. 1. The mutual engagement of cup 12 and support ring 18 ensures that cup 12 follows the rotary motion of rotary plate 22 and of support ring 18 connected to rotary plate 22 via support 20 without slip.

FIG. 4 shows, in a top view, a mixing means comprising three vessel stations 22A, 22B, and 22C. These vessel stations 22A, 22B, and 22C correspond each to a rotary plate 22 as shown in FIG. 1. Apart from this the mixing means shown in FIG. 1 equals the means of FIG. 1. Axis 40 is rotatable and thus permits a horizontal swing of housing 42. As an example in FIG. 4 a swing movement of housing 42 and receiving means 50 for the stirring wing is shown, which swing starts from a cup station 22C and leads to a cup station 22B, that is in the direction of arrow 89. The center points of the three work stations 22A, 22B, and 22C are located on a circle around the center of axis 40 having a radius which corresponds to the distance between the center of axis 40 and the axis A in FIG. 1. For this reason the circle of rotation in FIG. 4 is designated by A'.

Figure 5A:
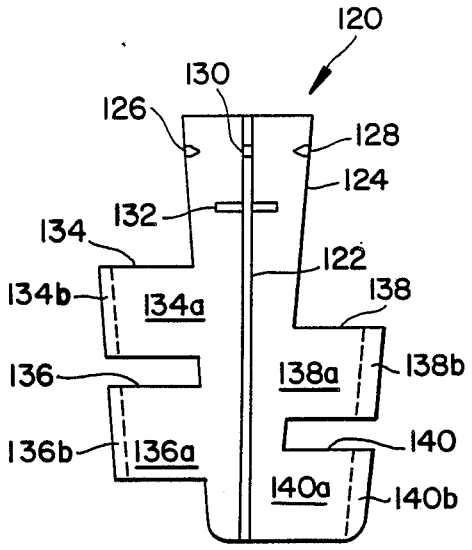
FIG. 5 shows and alternative embodiment of a mixing tool.
Figure 5B:
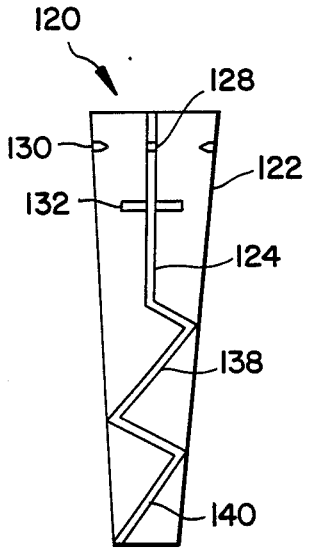
Figure 5C:
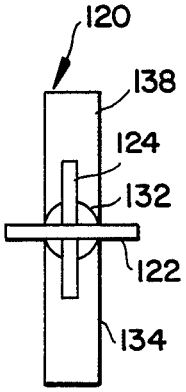
Figure 6A:
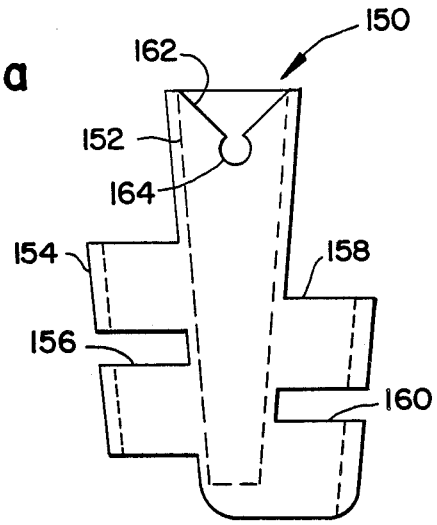
FIG. 6 shows another alternative embodiment of a mixing tool.
Figure 6B:
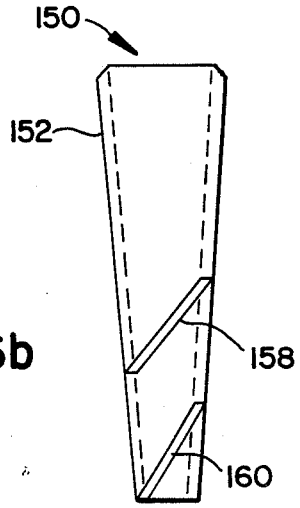

FIGS. 5 and 6 show particular advantageous embodiments of mixing tools according to the present invention.

In FIG. 5 a mixing tool is designated, as a whole, by reference number 120. Mixing tool 120 may be used instead of mixing tool 52 of FIG. 1. In detail, FIG. 5*a* shows a vertical cross section in a first representation and FIG. 5*b* shows a corresponding vertical cross section in a second representation which is turned with respect to FIG. 5*a* by 90° around the central axis, and FIG. 5*c* is a top view of mixing tool 120. Mixing tool 120 comprises two longish shaft ribs 122, 124 which are arranged in star-shaped fashion, that is displaced with respect to each other by 90°, which is shown particularly clearly in FIG. 5*c*. Shaft rib 124 has two recesses 126, 128 in its upper edge section and correspondingly shaft rib 122 is equipped with two recesses, only one of which (130) is discernible in FIGS. 5*a* and 5*b*. These recesses 126, 128, and 130 serve as locking recesses for lockingly engaging suitably formed locking protrusions provided in receiving means 50 of FIG. 1. The two shaft ribs 122, 124 of mixing tool 120 form together the shaft of mixing tool 120 and are further connected by reinforcing ribs 132 for improving the torsional strength.

Mixing tool 120 has four stirring wings 134, 136, 138, and 140, two of which (134, 136) are arranged at one edge of shaft rib 124 and protrude to the outside, and the other two (138, 140) are arranged at the opposing edge of shaft rib 124. No stirring wings are provided on the other shaft rib 122.

Each of stirring wings 134 to 140 comprises a relatively rigid inner section and an adjacent relatively flexible outer section. Thus the stirring wings 134 to 140, as a whole, have a relatively high flexural strength but are also able to adapt to the inner wall of a container due to the flexible outer sections.

In detail, stirring wing 134 comprises an inner section **134*a* and an relatively short outer section 134*b* radially outwards adjacent thereto. Inner section 134*a* and outer section 134*b* are formed as a single piece for forming a stirring wing 134 which, in turn, is formed as a single piece with shaft rib 124 and the mixing tool 120 as a whole. The cross section of outer section 134*b* is considerably smaller than that of more rigid inner section 134*a***.

In an analog fashion stirring wing 136 comprises an inner section **136*a* and an outer section 136*b*; stirring wing 138 has an inner section 138*a* and an outer section 138*b*, and stirring wing 140 is provided with an inner section 140*a* and an outer section 140*b***.

Furthermore, FIG. 5 explains the offset arrangement of the stirring wings, that is the arrangement of stirring wings at shaft rib 124 such that on one side lower stirring wing 140 is located, above which and in a distance upper stirring wing 138 is located. At the opposing side stirring wing 136 is arranged such that it covers the distance between stirring wings 140 and 138, and above stirring wing 136, again in a distance, stirring wing 134 is located. When mixing tool 120 rotates around its center axis, the four stirring wings 134 to 140 touch the entire area of the inner wall of a mixing cup without leaving a free space in between.

As can be seen from FIG. **5*b* the stirring wings are not vertically aligned but disposed at an oblique angle, as shown with stirring wings 138, 140; in this manner and up- and down-movement of the mixing products is produced during a rotation of mixing tool 120 around its center axis. The oblique angle of the stirring wings is further shown in the top view of mixing tool 120 in FIG. 5*c* where the two uppermost oblique stirring wings 134, 138** are discernable.

Figure 6C:
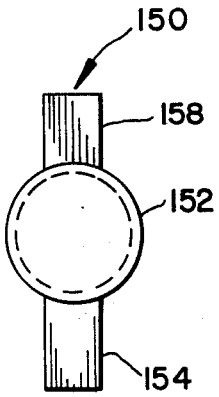

A further advantageous embodiment of a mixing tool 150 is shown in FIG. 6, again in a vertical cross section (FIG. **6*a*), a vertical cross section rotated by 90° (FIG. 6*b*), and in top view (FIG. 6*c*). The shaft of mixing tool 150 is formed by a hollow cylinder 152 tapered in the direction from top to bottom. In a single-piece arrangement stirring wings 154, 156, 158, and 160 are provided at the hollow cylinder 152 and the stirring wings 154 to 160 correspond in all other aspects to stirring wings 134 to 140 described above in connection with FIG. 5; in particular, stirring wings 154 to 160 also have inner sections and thinner, more flexible outer sections. At its upper end hollow cylinder 152 has a V-shaped recess 162 at the tip of which a circular locking recess 164 is provided. Into locking recess 164 a transverse axis, for example, of a receiving means 50** might snap in.

A hollow cylinder 152, similar to a mixing tool 120 equipped with shaft ribs, already has a high flexural strength if it is made as a single piece from a suitable synthetic resin. The flexural strength may be considerably enlarged if the hollow cylinder is turned up over a corresponding mandrel of receiving section 50. The mandrel may also be equipped with an ejecting means. For this purpose, the mandrel is preferably shaped as a hollow shaft which is traversed by a concentric guiding axis. If the hollow cylinder 152 is secured to locking recess 164 by a snapin locking, a downward action of the guiding axis (mechanically, pneumatically, electrically) is sufficient to unlock the entire mixing tool 150 and to detach it from receiving means 50.

A further advantageous embodiment of the mixing means according to the invention is shown in the upper left part of FIG. 1. Electrical connecting leads 100, 102 of electrical motor 44 are led, via an ammeter 104, to terminals 110, 112 to which an electrical supply voltage U for the electric motor 44 is supplied. For operation of the electric motor 44 a certain supply current is necessary for rotating mixing tool 52 (or 120 or 150) and this current depends, for example, on the transmission loss in gearing 48 and on the friction drag of stirring wings in cup 12. If mixing products are introduced into cup 12 additional power is required for moving the mixing products, leading to a higher current consumption of motor 44 which may be detected as a higher current determined by the ammeter. Therefore, a needle 108 on a scale 106 of ammeter starts to move from a first position. This additional current consumption is, therefore, a measure for the viscosity of the mixing products. Thus the viscosity of the mixing products may be easily determined, with a preceding calibration if necessary. Furthermore, a still further conformity of the mixing process may be achieved by monitoring the viscosity in such manner. For example, when two substances of different viscosity are to be mixed, the mixing may be performed until the viscosity of the resulting mixture remains substantially constant.

We claim:

1. Mixing means (10) comprising at least one mixing tool (52) and at least one mixing vessel (12) for mixing products, the mixing vessel (12) having a mixing chamber therein, where said mixing tool (52) is disposed, with respect to said mixing vessel (12), for providing a relative motion of said mixing tool (52) with respect to said mixing vessel (12), such that said mixing tool (52) is, at least partially, in contact with the mixing chamber of said mixing vessel (12) during the mixing process, the mixing tool (52) being provided with a shaft (122, 124) and stirring wings (134, 136, 138, 140), protruding from said shaft (122, 124) and comprising an inner section (**134*a*, 136*a*, 138*a*, 140*a*) adjacent to said shaft (122, 124) and an annexed outer section (134*b*, 136*b*, 138*b*, 140*b*), said outer section (134*b*, 136*b*, 138*b*, 140*b*) being substantially more flexible than said inner section (134*a*, 136*a*, 138*a*, 140*a*), wherein a rotating means (22, 24, 26) is provided for rotating said mixing vessel (12), wherein said rotating means (22, 24, 26) comprises receiving means (18, 20) for said mixing vessel (12), wherein said receiving means (18) and said mixing vessel may be detachably secured to each other by means of locking means (64, 66, 68, 70, 72, 74**).

2. A mixing means as claimed in claim 1, wherein recess means (70, 72, 74) are provided in said receiving means (18) and wherein locking protruding means (64,

66, 68) of a shape corresponding to said recess means are provided at said mixing vessel (12).

3. Mixing means (10) comprising at least one mixing tool (52) and at least one mixing vessel (12) for mixing products, the mixing vessel (12) having a mixing chamber therein, where said mixing tool (52) is disposed, with respect to said mixing vessel (12), for providing a relative motion of said mixing tool (52) with respect to said mixing vessel (12), such that said mixing tool (52) is, at least partially, in contact with the mixing chamber of said mixing vessel (12) during the mixing process, the mixing tool (52) being provided with a shaft (122, 124) and stirring wings (134, 136, 138, 140), protruding from said shaft (122, 124) and comprising an inner section (134*a*, 136*a*, 138*a*, 140*a*) adjacent to said shaft (122, 124) and an annexed outer section (134*b*, 136*b*, 138*b*140*b*), said outer section (134*b*, 136*b*, 138*b*, 140*b*) being substantially more flexible than said inner section (134*a*, 136*a*, 138*a*, 140*a*), wherein a mixing vessel (12) is provided which is rotatable around an axis (A) and which is rotationally symmetric and wherein said mixing tool is disposed on a axis (B) which runs in parallel distant relationship to said axis (A), wherein said mixing vessel (12) and/or said mixing tool (52) are movable in the direction of said axis (A) or said axis (B), respectively, wherein a post (32) is provided which extends, at least partially, parallel to said axis (A), and wherein a bracket (30) is attached to said post (32) and is slidingly movable with respect thereto, said bracket (30) having support means (28, 22) secured thereto for supporting said mixing vessel (12).

4. A mixing means as claimed in claim 3, wherein said support means comprizes a housing (28) in which said rotating means (22, 24, 26) is arranged.

5. Mixing means (10) comprising at least one mixing tool (52) and at least one mixing vessel (12) for mixing products, the mixing vessel (12) having a mixing chamber therein, where said mixing tool (52) is disposed, with respect to said mixing vessel (12), for providing a relative motion of said mixing tool (52) with respect to said mixing vessel (12), such that said mixing tool (52) is, at least partially, in contact with the mixing chamber of said mixing vessel (12) during the mixing process, the mixing tool (52) being provided with a shaft (122, 124) and stirring wings (134, 136, 138, 140), protruding from said shaft (122, 124) and comprising an inner section (134*a*, 136*a*, 138*a*, 140*a*) adjacent to said shaft (122, 124) and an annexed outer section (134*b*, 136*b*, 138*b*, 140*b* ), said outer section (134*b*, 136*b*, 138*b*, 140*b*) being substantially more flexible than said inner section (134*a*, 136*a*, 138*a*, 140*a*), wherein a mixing vessel (12) is provided which is rotatable around an axis (A) and which is rotationally symmetric and wherein said mixing tool is disposed on a axis (B) which runs in parallel distant relationship to said axis (A), wherein said mixing vessel (12) and/or said mixing tool (52) are movable in the direction of said axis (A) or said axis (B), respectively, wherein an axis (40) is provided extending in parallel relationship to said axis (B), said axis (40) being slidably carried in a bracket (34) and further being secured, at one end, to a housing (42) which is arranged, in a distal section with respect to said axis (40), for receiving said mixing tool (52).

6. A mixing means as claimed in claim 5, wherein said housing is slewable (arrow 89) around said axis (40).

7. A mixing means as claimed in claim 6, wherein locking means for locking into locking positions (22A, 22B, 22C) are provided.

8. A mixing process comprising the steps of:

feeding mixing products into a mixing vessel (12) having inner walls;

immersing at least a section of a mixing tool (52) for mixing the mixing products into said mixing products;

producing a relative stirring motion of said mixing tool (52) in said mixing vessel (12), and grazingly contacting the mixing tool against substantially all of the inner walls of said mixing vessel (12) that are in contact with the mixing products, wherein said mixing vessel (12) is rotated around an axis (A) and wherein said mixing tool extends substantially along an axis (B) which is in distant parallel relationship to said axis (A).

9. Mixing means (10) comprising at least one mixing tool (52) and at least one mixing vessel (12) for mixing products, the mixing vessel (12) having a mixing chamber therein, where said mixing tool (52) is disposed, with respect to said mixing vessel (12), for providing a relative motion of said mixing tool (52) with respect to said mixing vessel (12), such that said mixing tool (52) is, at least partially, in contact with the mixing chamber of said mixing vessel (12) during the mixing process, the mixing tool (52) being provided with a shaft (122, 124) and stirring wings (134, 136, 138, 140), protruding from said shaft (122, 124) and comprising an inner section (134*a*, 136*a*, 138*a*, 140*a*) adjacent to said shaft (122, 124) and an annexed outer section (134*b*, 136*b*, 138*b*, 140*b*), being substantially more flexible than said inner section (134*a*, 136*a*, 138*a*, 140*a*), wherein said shaft comprises two longitudinal ribs (122, 124) arranged in mutually transverse relationship.

10. Mixing means (10) comprising at least one mixing tool (52) and at least one mixing vessel (12) for mixing products, the mixing vessel (12) having a mixing chamber therein, where said mixing tool (52) is disposed, with respect to said mixing vessel (12), for providing a relative motion of said mixing tool (52) with respect to said mixing vessel (12), such that said mixing tool (52) is, at least partially, in contact with the mixing chamber of said mixing vessel (12) during the mixing process, the mixing tool (52) being provided with a shaft (122, 124) and stirring wings (134, 136, 138, 140), protruding from said shaft (122, 124) and comprising an inner section (134*a*, 136*a*, 138*a*, 140*a*) adjacent to said shaft (122, 124) and an annexed outer section (134*b*, 136*b* , 138*b*, 140*b*), said outer section (134*b*, 136*b*, 138*b*, 140*b*) being substantially more flexible than said inner section (134*a*, 136*a*, 138*a*, 140*a*), wherein said shaft is a preferably conically tapered hollow cylinder (152).

* * * * *